US009326627B1

(12) United States Patent
Horowitz

(10) Patent No.: US 9,326,627 B1
(45) Date of Patent: May 3, 2016

(54) DRINK GLASS HOLDER FOR A CHAIR

(71) Applicant: Brian Horowitz, Foothill Ranch, CA (US)

(72) Inventor: Brian Horowitz, Foothill Ranch, CA (US)

( * ) Notice: Subject to any disclaimer, the term of this patent is extended or adjusted under 35 U.S.C. 154(b) by 0 days.

(21) Appl. No.: 14/704,095

(22) Filed: May 5, 2015

(51) Int. Cl.
*A47C 7/62* (2006.01)
*A47G 23/02* (2006.01)
*A47G 19/22* (2006.01)

(52) U.S. Cl.
CPC ..... *A47G 23/0225* (2013.01); *A47C 7/62* (2013.01); *A47G 19/2255* (2013.01)

(58) Field of Classification Search
CPC ..... A47C 7/70; A47C 4/286; A47C 7/68; A47G 23/02; A47G 23/0225
USPC ..... 297/188.14, 411.45, 45, 188.02; 248/311.2
See application file for complete search history.

(56) References Cited

U.S. PATENT DOCUMENTS 4,213,649 A * 7/1980 Sell ..... 297/188.02
4,577,901 A * 3/1986 Phillips ..... A47C 4/02 224/155
4,961,555 A * 10/1990 Egan, Jr. ..... 248/231.81
5,096,152 A * 3/1992 Christiansen et al. ..... 248/311.2
5,257,765 A * 11/1993 Halle ..... 248/222.13
5,397,089 A * 3/1995 Kataoka ..... 248/311.2
5,511,755 A * 4/1996 Spykerman ..... 248/311.2
5,865,412 A * 2/1999 Mason ..... 248/311.2
6,149,238 A * 11/2000 Tsai ..... 297/411.43
6,209,951 B1 * 4/2001 Han ..... 297/45
6,467,839 B1 * 10/2002 Kain ..... 297/188.14
6,478,372 B1 * 11/2002 Lemmeyer et al. ..... 297/188.18
6,592,180 B2 * 7/2003 Combs ..... 297/188.14
6,663,068 B2 * 12/2003 Huang ..... 248/311.2
6,739,652 B2 * 5/2004 Welsh ..... 297/129
7,284,737 B2 * 10/2007 Kane ..... 248/311.2
7,530,632 B2 * 5/2009 Kaloustian et al. ..... 297/188.14
7,584,867 B2 * 9/2009 Burbrink ..... 220/737
8,182,031 B1 * 5/2012 MacKenzie ..... 297/135
8,757,572 B1 * 6/2014 Starr et al. ..... 248/311.2
8,777,307 B2 * 7/2014 Nelson et al. ..... 297/188.18
8,864,223 B2 * 10/2014 Larson et al. ..... 297/44
2010/0176643 A1 * 7/2010 Keaton et al. ..... 297/411.45
2011/0121619 A1 * 5/2011 Chappell ..... 297/188.01
2011/0132914 A1 * 6/2011 Vernes et al. ..... 220/575
2012/0292956 A1 * 11/2012 Gaudreau, Jr. ..... 297/188.04

* cited by examiner

*Primary Examiner* — Laurie K Cranmer
(74) *Attorney, Agent, or Firm* — Morland C. Fischer

(57) ABSTRACT

A drink glass holder attached to a chair to removably receive and retain a drink glass (e.g., a wine glass) that is filled with a drink when an individual seated in the chair wishes to lay his glass down or exit the chair while leaving his glass behind. The drink glass holder is connected to the chair by a connecting rod that extends between a side wall which turns upwardly from the chair seat to be joined to a chair arm and a hole formed in the body of the holder. The drink glass holder is positioned at the intersection of adjoining ends of the chair arm and the adjacent side wall of the chair seat. The drink glass is seated against and suspended from a bevel that surrounds an opening which extends longitudinally through the body of the drink glass holder within which the glass is received.

13 Claims, 2 Drawing Sheets

DRINK GLASS HOLDER FOR A CHAIR

BACKGROUND OF THE INVENTION

1. Field of the Invention

This invention relates to a drink glass holder that is attached to a chair and adapted to removably receive and retain a glass (e.g., a wine glass) of the kind having a long stem and a curved bowl atop the stem. The drink glass holder is preferably positioned at adjoining ends of a chair arm and an adjacent side wall of the chair seat to create a reliable and stable support for holding the glass in place especially when it is filled with a beverage and a seated individual wishes to lay his glass down or exit the chair while leaving his glass behind.

2. Background Art

Whether inside or out of doors, an individual seated on a chair will sometimes drink a beverage from a glass. At those times when the individual wishes to pause his drinking and/or to momentarily exit the chair without having to carry his glass, he often has no nearby surface on which to rest his beverage-filled glass. Thus, he can either lay his glass on the ground or on the arm of the chair. In these cases, the glass has no stable means of support, such that the glass can accidentally fall or be pushed over and the beverage contents spilled. In this same regard, even while it is being held in the seated individual's hand for a long time, the glass has been known to tip and its contents (e.g., wine) spilled in the individual's lap.

Therefore, what would be desirable is an non-obtrusive, easy-to-access drink glass holder that is attached to a chair to create a reliable and stable support for holding a glass in place should a seated individual wish to lay his glass down when he stops drinking or exits the chair while leaving his glass behind.

SUMMARY OF THE INVENTION

In general terms, a non-obtrusive, easy-to-access drink glass holder is disclosed to be attached to a chair. In accordance with a preferred embodiment, the drink glass holder is positioned at adjoining ends of a chair arm and an adjacent upstanding side wall which extends between the chair arm and the chair seat. The holder is fixed in place by means of one end of a frame rod projecting from the side wall of the chair seat for receipt by a hole formed in the body of the holder. The drink glass holder includes a cylindrical opening extending through the body thereof and a beveled lip surrounding the top of the opening. An entrance slot extends radially through the body so as to communicate with the cylindrical opening. The drink glass holder is particularly adapted to removably receive and retain a drink (e.g., wine) glass which has a long stem and a curved bowl at the top of the stem. The stem of the glass is first moved through the entrance slot in the body, and the curved bowl of the glass is then seated on the beveled lip. The holder creates a reliable and stable support for a drink glass especially when the glass is filled with a beverage and a seated individual wishes to lay his glass down or exit the chair while leaving his glass behind.

DESCRIPTION OF THE PREFERRED EMBODIMENT

Figure 1:
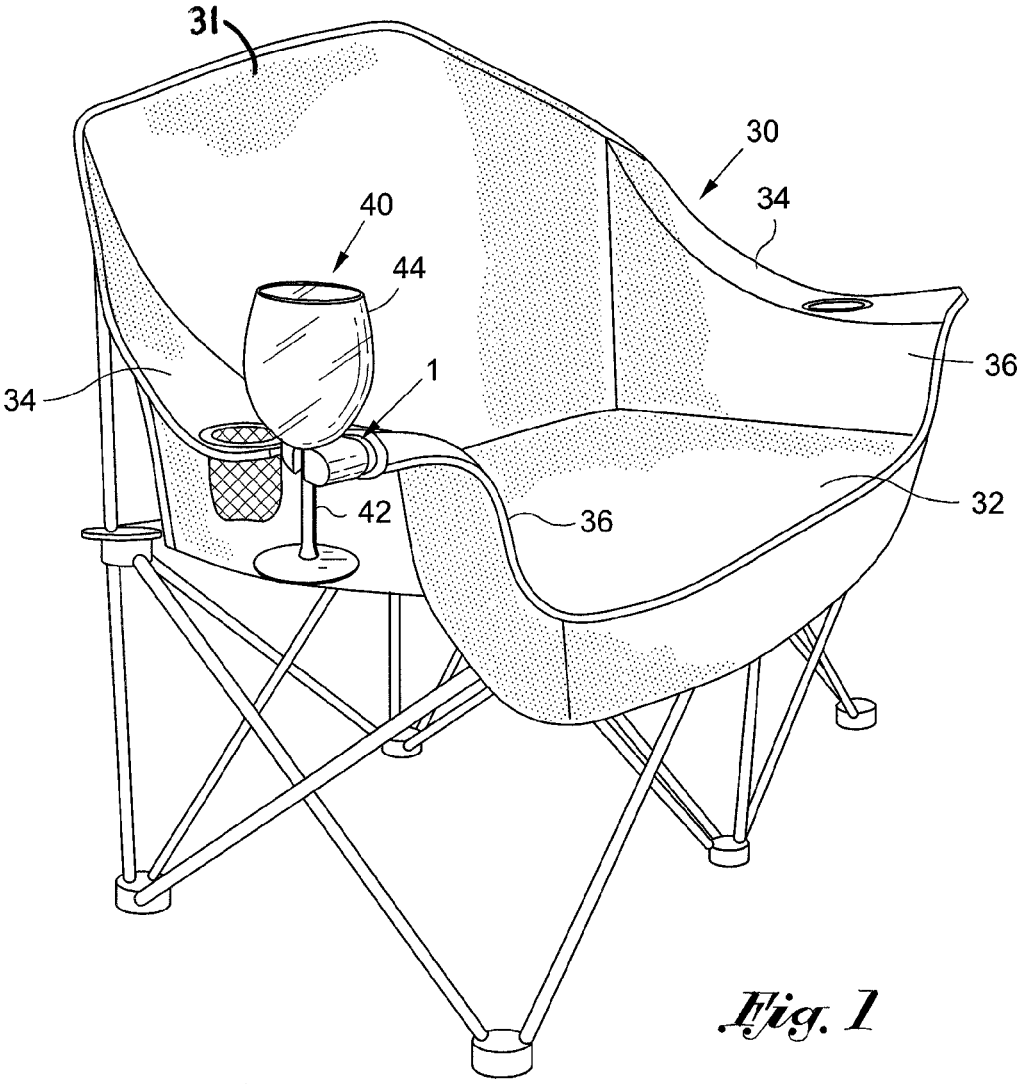
FIG. 1 shows a preferred embodiment for a drink glass holder according to the present invention attached to a chair.
Figure 2:
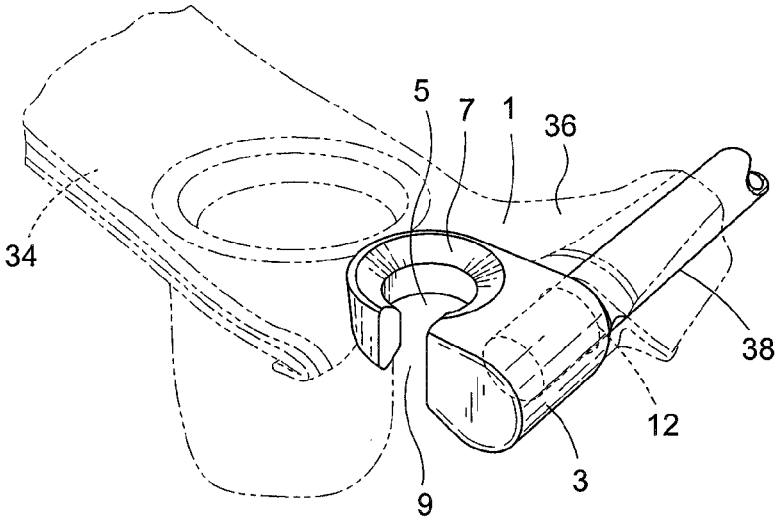
FIG. 2 shows a perspective view of the drink glass holder of FIG. 1 positioned at the intersection of a chair arm and an upstanding side wall that extends between the chair arm and the chair seat.
Figure 3:
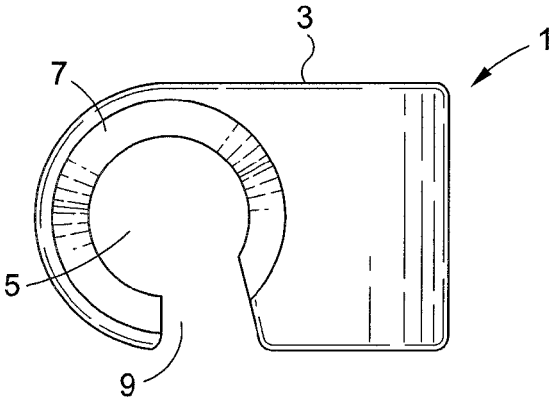
FIG. 3 is a top view of the drink glass holder of FIG. 2.
Figure 4:
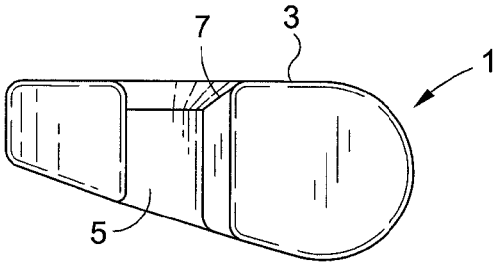
FIG. 4 is a left side view of the drink glass holder.

Referring initially to FIGS. 1 and 2 of the drawings, one example of a chair 30 is shown to which is attached the drink glass holder 1 of the present invention. It is to be expressly understood that the chair 30 to which the drink glass holder 1 is attached is not limited to that shown in FIG. 1. Thus, the chair can be an indoor chair, an outdoor recreational chair (as illustrated), a home chair, an office chair, or the like. In addition, other seating furniture (e.g., a couch, or the like) can be substituted for the chair 30. Likewise, the drink glass 40 to be held by the drink glass holder 1 is not limited to that illustrated in FIG. 1. However, it is preferable that the glass 40 have a tall narrow stem 42 and a curved bowl 44 at the top of the stem such as those common to a glass used for drinking water, wine, or the like.

The chair 30 has an upstanding back 31, a seat 32 and a pair of arms 34 located at opposite sides of the seat. Each chair arm 34 is joined to the chair seat 32 by an upstanding side wall 36 which runs continuously therebetween. In a preferred embodiment, the drink glass holder 1 is non-obtrusively positioned at the intersection of the adjoining ends of one of the chair arms 34 and the side wall 36 lying adjacent thereto.

Details of the drink glass holder 1 according to a preferred embodiment of this invention are now described while referring concurrently to FIGS. 2-6 of the drawings. The drink glass holder 1 has a solid body 3 that is manufactured from wood, plastic or any other suitable durable and weather-resistant material. A cylindrical glass-receiving opening 5 extends longitudinally and vertically through the body 3 of glass holder 1. The diameter of the cylindrical glass-receiving opening 5 must be smaller than the widest dimension of the curved bowl 44 of the glass (40 of FIG. 1) to be held by the drink glass holder 1. Likewise, the diameter of the cylindrical opening 5 must be large enough to accommodate therewithin the stem (42 of FIG. 1) of the glass 40.

A beveled lip 7 surrounds the top of the cylindrical glass-receiving opening 5 through the body 3 of holder 1. The beveled lip 7 is configured to create a seat against which the curved bowl 44 of the glass 40 is laid when the glass is retained by the holder 1 in the manner shown in FIG. 1.

An entrance slot 9 extends radially through the body 3 of the drink glass holder 1. The radially-extending entrance slot 9 communicates with the vertically-extending cylindrical glass-receiving opening 5. In order to permit easy access to the glass holder 1, the slot 9 is positioned on the outside of the holder body 3 so as to face away from the chair arm 34 and the adjacent side wall 36. The slot 9 is sized to permit the stem 42 of the glass 40 to pass therethrough whenever the glass is moved into and removed from the glass-receiving opening 5 of drink glass holder 1. With the glass 40 moved into receipt by the drink glass holder 1, and as is best shown in FIG. 1, the stem 42 of glass 40 projects downwardly through the vertically-extending glass-receiving opening 5 in the body 3, and the curved bowl 44 of the glass will rest against and be suspended from the beveled lip 7 which surrounds the top of the glass-receiving opening 5. As previously explained, the beveled lip 7 creates a reliable and stable seat for supporting the bowl 44 and thereby holding the glass in place especially when the glass is filled with a beverage and one seated in the chair seat 32 next to the glass holder 1 wishes to lay down his glass or exit the chair 30 while leaving his glass behind.

Figure 5:
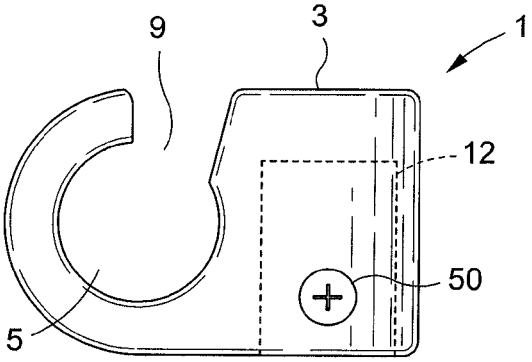
FIG. 5 is a bottom view of the drink glass holder.
Figure 6:
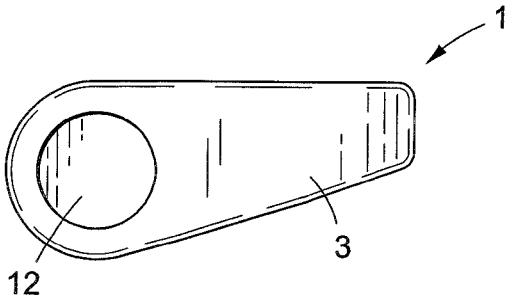
FIG. 6 is a rear view of the drink glass holder.

As is best shown in FIGS. 2 and 5, a hole 12 is formed in the side of the body 3 of the drink glass holder 1 which lies adjacent the side wall 36 and opposite the side through which the entrance slot 9 extends. The hole 12 in the side of the body 3 is sized to form a snug fit for a tubular frame rod (designated 38 and best shown in FIG. 2) that extends from the adjacent side wall 36 of chair 30 for receipt within the hole 12. The receipt of the frame rod 38 by the hole 12 in the holder body 3 helps to avoid a detachment and separation of the drink glass holder 1 from the chair 30. In this same regard, a fastener (designated 50 and best shown in FIG. 5) is moved through the bottom of body 3 and into engagement with the end of the frame rod 38 that is received inwardly of the hole 12 to prevent a detachment of rod 38 from the body 3 of drink glass holder 1.

In order to provide additional support for securing the drink glass holder 1 in place on the chair 30 of FIG. 1, the end of the chair arm 24 adjacent holder 1 may be recessed. In this case, the recess (not shown) would be shaped to conform to and surround the rear of the body 3 so that the drink glass holder 1 would also be carried by the chair arm.

We claim:

1. A combination, comprising:

a chair including a seat, a pair of arms located at opposite sides of the seat, and a pair of side walls, each of said pair of side walls extending from one side of the seat to one of the pair of arms, such that said pair of side walls are joined to respective ones of said pair of arms;

a drink glass holder connected to the chair at the intersection of one of said pair of side walls and a respective one of said pair of arms, said drink glass holder having a body and a hole formed in said body;

a connecting rod extending outwardly from said chair for receipt within the hole formed in the body of said drink glass holder by which said drink glass holder is connected to said chair, and a fastener extending through the body of said drink glass holder for engaging said connecting rod that is received within the hole formed in said body to prevent a separation of said drink glass holder from said connecting rod.

2. The combination recited in claim 1, wherein said connecting rod is connected between the hole formed in the body of said drink glass holder within which said connecting rod is received and one of the pair of side walls of said chair.

3. The combination recited in claim 1, wherein the body of said drink glass holder also has an opening including a top and a bottom and extending vertically through said body within which to receive a drink glass to be held by said drink glass holder adjacent said chair.

4. The combination recited in claim 3, wherein the body of said drink glass holder also has a bevel formed therein and extending around the top of said vertically-extending opening, said bevel being shaped to create a seat at which the drink glass is held and suspended.

5. The combination recited in claim 3, wherein the body of said drink glass holder also has an entrance slot that communicates with said vertically-extending opening, said entrance slot being sized to permit the drink glass to pass therethrough for receipt at said vertically-extending opening.

6. A combination, comprising:

a chair including a seat, a pair of arms located at opposite sides of the seat, and a pair of side walls, each of said pair of side walls extending from one side of the seat to one of the pair of arms;

a drink glass including an elongated stem and a curved bowl at the top of the stem to be filled with a drink;

a drink glass holder at which said drink glass is received and held, said drink glass holder having a body and a hole formed in said body;

a connection extending between the hole formed in the body of said drink glass holder and one of the pair of side walls of said chair by which said drink glass holder is connected to said chair, said connection projecting horizontally outward from the one of said pair of side walls so as to lie in parallel alignment with the seat of said chair; and a fastener extending through the body of said drink glass holder for engaging said connection at the hole formed in said body to prevent a separation of said drink glass holder from said connection.

7. The combination recited in claim 6, wherein said connection is a rod extending horizontally outward from the one of said pair of side walls for receipt within the hole formed in the body of said drink glass holder by which to connect said drink glass holder to said chair.

8. The combination recited in claim 7, wherein the body of said drink glass holder also has an opening including a top and a bottom and extending vertically through said body within which to receive the elongated stem of the drink glass to be received and held by said drink glass holder.

9. The combination recited in claim 8, wherein the body of said drink glass holder also has a bevel formed therein and extending around the top of said vertically-extending opening, said bevel being shaped to create a seat at which the curved bowl of the drink glass is held and suspended.

10. The combination recited in claim 8, wherein the body of said drink glass holder also has an entrance slot that communicates with said vertically-extending opening, said entrance slot being sized to permit the elongated stem of the drink glass to pass therethrough for receipt at said vertically-extending opening.

11. A combination comprising:

a chair including a seat, a pair of arms located at opposite sides of the seat, and a pair of side walls, each of said pair of side walls extending from one side of the seat to one of the pair of arms;

a drink glass holder connected to the chair at one of the pair of side walls thereof, said drink glass holder having a hole formed therein; and a connecting rod projecting from the one of said pair of side walls for receipt within the hole formed in said drink glass holder by which said drink glass holder is connected to the chair, said connecting rod extending horizontally within the one of said pair of side walls so as to be aligned parallel to the seat of the chair.

12. The combination of claim 11, further comprising a fastener extending through said drink glass holder to engage said connecting rod at the hole of said drink glass holder within which said connecting rod is received to thereby prevent a separation of said drink glass holder from said connecting rod.

13. The combination recited in claim 11, wherein said drink glass holder connected to the chair at the one of said pair of side walls thereof lies adjacent one of the pair of arms of the chair.

* * * * *